US010036547B2

(12) United States Patent
Sokolov

(10) Patent No.: US 10,036,547 B2
(45) Date of Patent: Jul. 31, 2018

(54) LED LUMINAIRE

(71) Applicant: SOCIETY WITH LIMITED LIABILITY "DIS PLUS", Moscow (RU)

(72) Inventor: Yuriy Borisovich Sokolov, Fryazino (RU)

( * ) Notice: Subject to any disclaimer, the term of this patent is extended or adjusted under 35 U.S.C. 154(b) by 111 days.

(21) Appl. No.: 15/117,387

(22) PCT Filed: Jun. 26, 2014

(86) PCT No.: PCT/RU2014/000460
§ 371 (c)(1),
(2) Date: Jun. 20, 2017

(87) PCT Pub. No.: WO2015/088383
PCT Pub. Date: Jun. 18, 2015

(65) Prior Publication Data

US 2018/0128476 A1 May 10, 2018

(51) Int. Cl.

| | |
|---|---|
| ***F21V 31/00*** | (2006.01) |
| ***F21V 29/15*** | (2015.01) |
| ***F21V 29/70*** | (2015.01) |
| ***F21S 2/00*** | (2016.01) |
| ***F21S 4/28*** | (2016.01) |
| ***F21V 15/01*** | (2006.01) |
| *F21Y 115/10* | (2016.01) |

(52) U.S. Cl.
CPC ..... *F21V 31/005* (2013.01); *F21S 2/005* (2013.01); *F21S 4/28* (2016.01); *F21V 15/01* (2013.01); *F21V 29/15* (2015.01); *F21V 29/70* (2015.01); *F21Y 2115/10* (2016.08)

(58) Field of Classification Search
CPC ..... F21V 31/005; F21V 15/01; F21V 29/70; F21V 29/15; F21S 4/28; F21S 2/005; F21Y 2115/10
See application file for complete search history.

(56) References Cited

U.S. PATENT DOCUMENTS

| | | | |
|---|---|---|---|
| 7,534,002 | B2 | 5/2009 | Yamaguchi et al. |
| 2012/0099317 | A1 | 4/2012 | Liu |
| 2013/0215606 | A1 | 8/2013 | Wang et al. |

FOREIGN PATENT DOCUMENTS

| | | | |
|---|---|---|---|
| CN | 201014370 | Y | 1/2008 |
| CN | 203068326 | U | 7/2013 |
| GB | 2 348 272 | A | 9/2000 |
| JP | 2008-091185 | A | 4/2008 |
| RU | 112 340 | U1 | 1/2012 |

(Continued)

*Primary Examiner* — Kevin Quarterman
(74) *Attorney, Agent, or Firm* — Bryant J. Keller; Kirton McConkie

(57) ABSTRACT

The technical result of the invention is the creation of a moisture-proof LED luminaire with improved reliability and efficiency resulting from the provision of non-temperature dependent operating conditions for a power supply and LEDs by mounting same on different bodies (a first body and a third body) which are heat-insulated from each other by an end connector and an end cap made of a heat-insulating material; the claimed LED luminaire also exhibits more efficient heat removal from the LEDs as a result of the presence of an additional second body having thermal contact with the first body, and improved usability, particularly a faster and less labor-intensive procedure for replacing the power supply because said power supply is mounted on the third body, which can be easily flipped open.

20 Claims, 1 Drawing Sheet

(56) References Cited

FOREIGN PATENT DOCUMENTS

Figure 1:
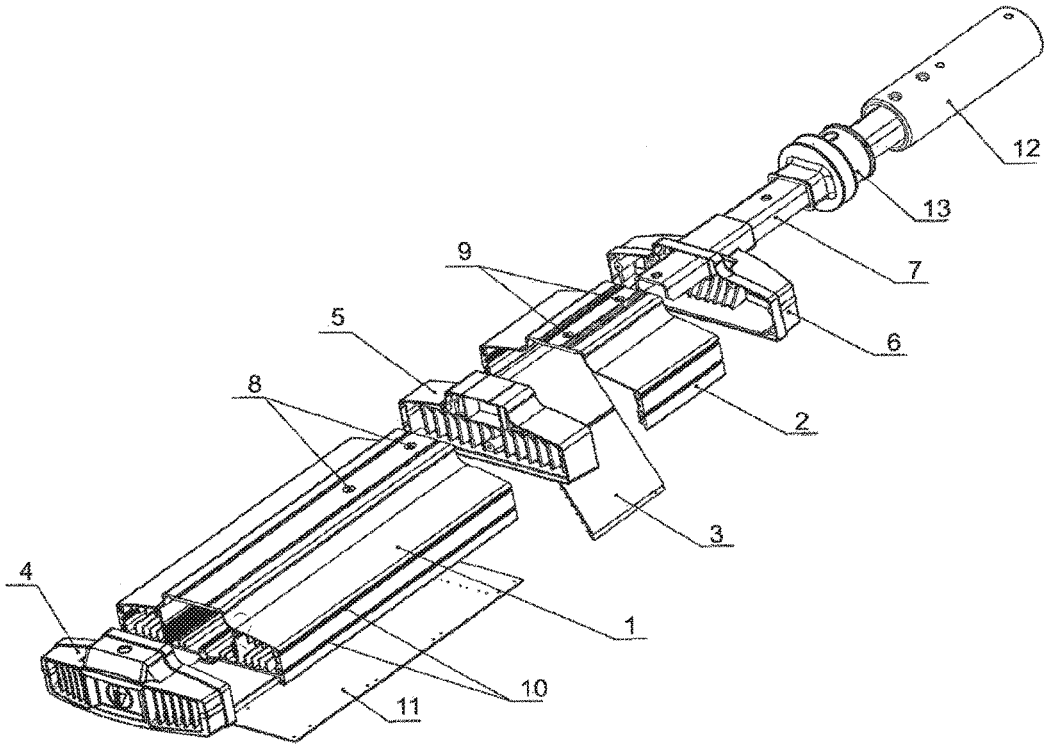

| | | | |
|---|---|---|---|
| RU | 118 398 | U1 | 7/2012 |
| RU | 128 696 | U1 | 5/2013 |
| SU | 629403 | A1 | 10/1978 |
| SU | 1227910 | A1 | 4/1986 |
| TW | 201329388 | A | 7/2013 |
| WO | 88/02460 | A1 | 4/1988 |
| WO | 2013/063898 | A1 | 5/2013 |

LED LUMINAIRE

PERTINENT ART

The invention refers to the illuminating engineering sphere, notably to LED luminaires, and may be used as a source of light in the street (particularly, to be an illuminating element of a lamp pole) and inside a room.

STATE OF THE ART

Modern LED luminaires are effective sources of light, consume a little power and are characterized by long operating life. Usually, high-capacity LED structure includes radiator for abstraction of heat from the LEDs and power source. Quite often LED luminaire case is used as this radiator, if it is produced of heat-conducting material. And temperature inside the case is the same for LED and power source, which is often unacceptable, because LEDs may operate even at 85-90 C case temperature, but for power source this temperature is destructive. Besides this, nowadays LEDs operating life may be more than 100 thousand hours, but power source operating life doesn't exceed 30-40 thousand hours. This displays that for the period of 10-15 years it is necessary to renew the power source in a LED luminaire, set on a lamp pole or any other hard-to-reach external element, which is usually located on a big height, at least once. Replacement of the power source should be performed quickly and easily, without taking the LED luminaire from its location. Besides this, because street and tunnel LED luminaires operate in condition of low and high temperatures, and high humidity, it is necessary for them to be resistant to such external actions during 10-15 years of operation.

The device that is the closest to the claimed invention is a LED luminaire, described in patent CN203068326 (U), which contains the first case and the second case, produced of heat-conducting material in the form of hollow sections with open end parts and one end plug, produced of heat-conducting material and having through ventilation openings, and the third case, having through ventilation openings, power source, at least one fastening device and at least one optical member with LEDs. The first case and the second case are connected from the end parts, and the other end part of the first case is closed by an end plug, and the other end part of the second case is performed as a solid wall. The second case has an open bottom part, which is connected with the third case, and the power source is electrically connected with the optical members and with LEDs, and produced with a possibility of external power supply adaptation to the LEDs power supply parameters, and fixed inside the hollow of the second case to the second case, producing a thermal contact. Optical members with LEDs are connected with the bottom part of the first case and consist of circuit boards, on one side of which LEDs are located, and lens plates, which cover LEDs and are connected with circuit boards. At the backside, circuit boards are connected with the cases, which are connected with external bottom cooling fins of the first case, forming a thermal contact. The third case is connected with open bottom part of the second case by detached connections, performed with a possibility of disconnection of the third case for power source replacement. The fastening device is connected with the second case and produced with a possibility of fastening the LED luminaire to the external bearing element. Ventilation openings of the end plug are not connected with the hollow of the first case and don't let in convection air flows. Outer walls and internal cooling fins of the first case together with cases (connected to the circuit boards from the backside) of the optical members form longitudinal ventilation ducts, that are closed at the ends of the first case, that's why they don't let in convection air flows, cooling the first and second cases, the third case and the power source. Ventilation openings of the third case let in convection air flows only into the hollow of the second case. This LED luminaire is selected as the prototype of the claimed invention.

Disadvantage of the prototype LED luminaire is insufficient cooling of the first case, that may lead to overheat and fail of LEDs and power source due to the fact, that the first case hollow is closed at all sides doesn't let in convection air flows.

INVENTION DISCLOSURE

The task of the claimed invention is creation of a damp-proof LED luminaire of improved reliability and effectiveness by creating thermally independent operation conditions of the power source and LEDs, by installing them in different cases (the first and the third cases), which are heat-insulated from each other by edge connector and end plug, produced of heat insulator; with increased effectiveness of heat removal from LEDs by auxiliary second case, having thermal contact with the first case; and with increased usage comfort, notably with faster and less laborious procedure of power source replacement by installing the power source in the third case, easily open by tilting.

The problem is decided by creating a LED luminaire, containing the first and the second cases, made of heat-conducting material in the form of hollow sections with open ends, edge connector and two end plugs, made of heat insulator and having through ventilation openings, the third case, made of heat-conducting material, and a hermetic power source, at least one fastening device and at least one optical member with LEDs, which is connected with the external surface of the bottom part of the first case, forming a thermal contact and performed hermetic, and the first case and the second case are connected with each other by end parts via edge connector, and other two end parts of the first and the second cases are closed by the front and rear end plugs, and the second case has an open bottom part, closed by the third case, and the hermetic power source is electrically and hermetically connected with optical members with LEDs and fixed to the third case, forming a thermal contact, and the power source is located in the hollow of the second case, and the fastening device is connected with the first and second cases and performed with a possibility of fastening the LED luminaire to the external element, and ventilation openings of the end plugs are connected with the hollows of the first and second cases and are performed with a possibility of letting in convection air flows, and the walls of the first case form the first ventilation duct, and the walls of the second and third cases form the second ventilation duct, and the first and the second ventilation ducts are connected to each other via ventilation openings of the edge connector and are produced with a possibility of letting in the convection air flows, cooling the first, second and third cases and the power source, and the third case is connected with the rear end plug and the edge connector by detached connections, produced with a possibility of disconnection of the third case to replace the power source.

In the preferred variant of LED luminaire embodiment, the third case is connected with the rear end plug and the edge connector on one side by two articulated joints, and on the other by at least two threaded connections, and the third case is produced with a possibility of opening to replace the power source by turning in articulated joints in case of bolted out captive screws of threaded connections.

In the preferred variant of LED luminaire embodiment, the first threaded connection consists of a threaded opening in the third case, through opening in the rear end plug and a screw, bolted in the threaded opening in the third case and passing through the opening in the rear end plug; the second threaded connection consists of a threaded opening in the third case, through opening in the edge connector and a screw, bolted in the threaded opening in the third case and passing through the opening in the edge connector; the first articulated joint consists of the opening in the rear end plug, an opening in the third case and a shaft, inserted in them, performed in the form of a screw with a nut; the second articulated joint consists of the opening in the edge connector, an opening in the third case and a shaft, inserted in them, performed in the form of a screw with a nut.

In the preferred variant of LED luminaire embodiment, the first and the second cases are connected with the end plugs by at least two threaded connections, each of them consists of threaded openings in the end part of the first and second cases, through openings in the end plugs and screws, bolted in the threaded openings and passing through the openings.

In the preferred variant of LED luminaire embodiment, the first case has internal walls, which divide the hollow of the first case into through ventilation ducts, having entrances and exits at the end parts of the first case and performed with a possibility of letting in the convection air flows, cooling the first case.

In the preferred variant of LED luminaire embodiment, two internal vertical walls divide the hollow of the first case into three through ventilation ducts.

In the preferred variant of LED luminaire embodiment, the first, second and third cases are produced as aluminum structural extrusions.

In the preferred variant of LED luminaire embodiment, the second case has a U-shape cross-section, and the first case has a rectangular cross-section.

In the preferred variant of LED luminaire embodiment, the outer surface of the third case and the internal surface of the first case have longitudinal cooling fins.

In the preferred variant of LED luminaire embodiment, the optical member with LEDs consists of a circuit board, on one side of which there are LEDs, and a lens plate, which covers the LEDs and hermetically connected with a circuit board, and the optical member with LEDs is connected with the external surface of the bottom wall of the first case by connection, which consists of connection knobs, located on the outer surface of the bottom wall of the first case, and hitches, inserted in the connection knobs, and the hitches are performed in the shape of flexible elastic moldings.

In the preferred variant of LED luminaire embodiment, the lens plate is hermetically connected with the circuit board by an encapsulant, performed as silicone grease.

In the preferred variant of LED luminaire embodiment, the optical member with LEDs has a rectangular form, and pressed to the external surface of the bottom wall of the case by hitches along at least two sides.

In the preferred variant of LED luminaire embodiment, the fastening device contains a crosstop and a field tube, and the front end of the crosstop is connected with the first the first and second cases, and the rear end is connected with the field tube, which is performed with a possibility of connection with an external bearing element.

In the preferred variant of LED luminaire embodiment, the crosstop front end is consecutively inserted into the opening in the rear end plug, into the hollow of the second case, into the edge connector and into the central ventilation duct of the first case and is connected with the first and second cases by thread connections, consisting of threaded rivets, fixed in the crosstop, and screws, bolted in the thread rivets and passing through the openings in the first and second cases, and the place of connection of the crosstop and the field tube is covered with a protective corrugated pipe.

In the preferred variant of LED luminaire embodiment, the rear end of the crosstop is inserted in the field tube and connected with it by threaded connection, consisting of threaded rivets, fixed in the crosstop, and bolts, screwed in the threaded rivets and passing through the openings in the field tube and in the stiffening plate, located under the crosstop.

In the preferred variant of LED luminaire embodiment, the field tube is produced with a possibility of connection with an external bearing element by a connection, consisting of threaded through openings in the field tube and bolts, produced with a possibility of bolting in the threaded openings and fixation of the external bearing element, inserted in the field tube.

In the preferred variant of LED luminaire embodiment, the luminaire contains a bar, which is connected with the first and second cases, forming a thermal contact, and bar thermal conduction is higher than thermal conduction of the first and/or the second cases.

In the preferred variant of LED luminaire embodiment, side walls of the first and second cases have external T-shape long slots.

In the preferred variant of LED luminaire embodiment, fastening device is an H-shaped longitudinal connector, produced with a possibility of locating one of its parts and in T-shape long slots of the first and second cases and the fastening device of its other part to the external element.

In the preferred variant of LED luminaire embodiment, the external element is a neighbor LED luminaire, which also has external T-shape long slots in side walls.

In the preferred variant of LED luminaire embodiment, the LED luminaire contains at least one additional cooling element of reflecting element, having a T-shape cusp, located in a T-shape long slot of the case side wall.

In the preferred variant of LED luminaire embodiment, the LED luminaire contains a decorative side molding, located in the T-shape long slot of the case side wall.

In the preferred variant of LED luminaire embodiment, the LED luminaire contains decorative top moldings, fixed longitudinally at the external surface of the top walls of the first and second cases and covering the places of connection of the first and second cases with a crosstop.

In the preferred variant of LED luminaire embodiment, the power source is electrically and hermetically connected with optical members with LEDs by electrical hermetic connection, consisting of hermetic electrical wiring and hermetic electrical wire-wire connectors.

In the preferred variant of LED luminaire embodiment, the edge connector has extra through ventilation openings, going out and performed with a possibility of letting in additional convection air flows to the first and second ventilation ducts.

In the preferred variant of LED luminaire embodiment, it contains a control unit, connected with the power source and performed with a possibility of brightness control and other parameters of the LED luminaire.

In the preferred variant of LED luminaire embodiment, the control unit is performed radio-controlled or controlled by signals, transferred via wire electric network of LED luminaire power supply.

LIST OF DRAWING MATERIALS

For better understanding of the claimed invention, further its detailed description with relative drawings is presented.

FIGURE. Isometric view of LED embodiment variant.

ELEMENTS

1—first case;
2—second case;
3—third case;
4—front end plug;
5—edge connector;
6—rear end plug;
7—crosstop;
8—through openings in the first case;
9—through openings in the second case;
10—T-shape long slots;
11—optical member with LEDs;
12—field tube;
13—protective corrugated tube.

BEST MODE OF INVENTION EMBODIMENT

Let's examine the variant of embodiment of the claimed LED luminaire, shown in the FIGURE.

The claimed LED luminaire contains the first case 1 and the second case 2, made of heat-conducting material as hollow sections with open end parts; edge connector 5, front end plug 4 and rear end plug 6, made of heat insulator and having through ventilation openings. LED luminaire also contains the third case 3, hermetic power source (not shown), optical members 11 with LEDs and a fastening device, containing a crosstop 7, field tube 12 and a protective corrugated tube 13.

The first case 1 and the second case 2 are connected with each other at the end parts via the edge connector 5, and other two end parts of the first and second cases 1, 2 are closed by end plugs 4, 6. The second case 2 has an open bottom part, which is closed by the third case 3. Hermetic power source is electrically and hermetically connected with optical members 11 with LEDs. The power source is fixed to the third case 3, forming a thermal contact and located in the hollow of the second case 2. Optical members 11 with LEDs are connected with the external surface of the bottom part of the first case 1, forming a thermal contact, performed hermetic and consist of circuit boards, at one side of which LEDs are located, and lens plates, which cover the LEDs and hermetically connected with the circuit boards. Ventilation openings of end plugs 4, 6 are connected with the hollows of the first and second cases 1, 2 and performed with a possibility of letting in convection air flows. The walls of the first case 1 form the first ventilation duct, and the walls of the second case 2 and the third case 3 form the second ventilation duct. The first and the second ventilation ducts are connected through ventilation openings of the edge connector 5 and performed with a possibility of letting in convection air flows, cooling the first and second cases 1, 2, the third case 3 and the power source. The third case 3 is connected with the rear end plug 6 and edge connector 5 by detached connections, performed with a possibility of disconnection of the third case 3 to replace the power source.

The third case 3 is connected with the rear end plug 6 and edge connector 5 at one side and by two articulated joints, and at the other side by two threaded connections, and the third case 3 is performed with a possibility of opening to replace the power source by turning in the articulated joints in case of bolted-out threaded connections captive screws. The first threaded connection consists of threaded opening in the third case 3, through opening in the rear end plug 6 and a screw, bolted in the threaded opening in the third case 3 and passing through the opening in the rear end plug 6. The second Втopoe threaded connection consists of threaded opening in the third case 3, through opening in the edge connector 5 and a screw, bolted in the threaded opening in the third case 3 and passing through the opening in the edge connector 5. The first articulated joint consists of the opening in the rear end plug 6, opening in the third case 6 and a shaft, inserted in them, performed as a screw with a nut. The second articulated joint consists of the opening in the edge connector 5, openings in the third case and a shaft, inserted in them, performed as a screw with a nut.

The first and second cases 1, 2 are connected with end plugs 4, 6 by four thread connections, each of them consists of thread openings in the end part of the first and second cases 1, 2 and screws, bolted in the threaded openings and passing through the openings in the end plugs 4, 6.

The first case 1 has two internal vertical walls, which divide the hollow of the first case 1 into three through ventilation ducts, having entrances and exits at the end parts of the first case 1 and performed with a possibility of letting in convection air flows, cooling the first case 1.

The first case 1, the second case 2 and the third case 3 are performed as aluminum structural extrusions.

The second case 2 has a U-shaped cross section.

The first case 1 has a rectangular cross section.

External surface of the third case 3 and internal surface of the first case 1 have longitudinal cooling fins.

Optical members 11 with LEDs and external surface of the bottom wall of the first case 1 are connected by a connection, which consists of knobs on the external surface of the bottom wall of the first case 1 and the knobs, inserted in connecting cusps, and optical members 11 with LEDs are pressed by knobs to the external surface of the bottom wall of the first case 1. The knobs are performed as elastic flexible moldings.

Optical members 11 with LEDs are conjugated with the external surface of the bottom wall of the first case 1 via the gasket, made of heat-resistant rubber.

Lens plates are hermetically connected with circuit boards by sealing agent, made of silicon joint sealant.

Optical members 11 with LEDs have a rectangular form, and are pressed by hitches to the external surface of the bottom wall of the first case 1 along two sides.

Fastening device contains a crosstop 7 and a field tube 12. The front end of the crosstop 7 is connected with the first case 1 and second case 2, and the rear end of the crosstop 7 is connected with a field tube 12, which is performed with a possibility of connection with external bearing element. Connection of the crosstop 7 and the field tube 12 is covered by protective corrugated tube 13.

The front end of the crosstop 7 is inserted in the opening in the back end plug 6, in the hollow of the second case 2, in the edge connector 5 and in the central ventilation duct of the first case 1 and is connected with the first and second cases 1, 2 by thread connections.

Rear end of the crosstop 7 is inserted in the field tube 12 and connected with it by thread connection.

Field tube 12 is performed with a possibility of connection with external bearing element by a connection, consisting of through threaded openings in the field tube and bolts, performed with a possibility of bolting in to the threaded openings and fixation of the external bearing element, inserted into the field tube 12.

Side walls of the first and second cases 1, 2 have a T-shape long slots 10, where decorative side moldings are located.

The external bearing element may be a bearing element of lamp pole, neighbor LED luminaire, ceiling, walls.

The power source is fastened to the third case 3 by thread connections, each of them consists of threaded openings in the power source and screws, bolted in the threaded openings and passing through the openings in the third case 3.

The power source is electrically and hermetically connected with optical members 11 with LEDs by hermetic electrical connection, consisting of hermetic electrical wiring and wire-wire type hermetic electrical connectors.

Fastening of the claimed LED luminaire to the external bearing element only through cases 1, 2 improves heat removal and doesn't load the end plugs 4, 6 and the edge connector 5, connecting the first and second cases 1 and 2.

Damp protection of the claimed LED luminaire is provided by sealing the power source and optical members 11 with LEDs, and connections of all other structural elements of the claimed LED luminaire are not sealed.

To provide a fast replacement of the power source of the claimed LED luminaire there is a disconnection of one side of the third case 3 from the side wall of the second case 2 after bolting out the screws of thread connections without dismantling other elements of the claimed LED luminaire.

To achieve high level of sealing of the claimed LED luminaire in case of temperature drops, optical members 11 with LEDs are connected with the first case 1 by moldings. This kind of connection provides «floating» condition of the optical members 11 on the surface of the first case 1 (unlike threaded connection). Every optical member 11 consists of aluminum circuit board, which is connected with the external surface of the bottom wall of the first case 1 and with lens plates, and the connection is sealed by silicon of high degree of viscosity, compensating the difference of aluminum coefficient of expansion, the first case 1 made of, and lens plates. Change of lens plates type leads to the change of light source type without changing other structural elements of the claimed LED luminaire.

Increase or decrease of the claimed LED luminaire power is made by increasing or decreasing of section length of the first and second cases 1, 2 and the third case 3 and, correspondingly change of LEDs and lenses number in lens plates in optical members 11, change of number of optical members 11 with LEDs and replace of power source for the one of higher capacity without changing other structural elements of the claimed LED luminaire.

If it is necessary to lower the temperature of LEDs and in case of increase of LEDs capacity in the claimed LED luminaire, there is a possibility to increase the cooling area by attaching additional cooling elements ("blades"), inserted into T-shape long slots 10, to cases 1, 2.

Besides this, it is possible to achieve temperature decrease of LEDs in case of LEDs capacity increase in the claimed LED luminaire is possible by installing a bar, which is connected with the first and second cases 1, 2, forming a thermal contact. Bar heat conductivity is higher than heat conductivity of the first and/or second cases, and it allows to transfer more heat (comparing with heat, transferred by crosstop 7) from the first case 1 to the second case 2, and due to this provide better cooling of optical members 11 with LEDs, connected to the first case 1. In this case heating of case 2 is not transferred to the third case 3 and to the power source, installed on it, because the second case 2 and the third case 3 are separated from each other by edge connector 5 and rear end plug 6, made of heat insulator.

Besides this, symmetric illumination power growth is possible by connecting a number of claimed LED luminaires by H-shape longitudinal connectors, performed with a possibility of inserting into T-shape long slots 10, and power of 500 W is easily reached, and it corresponds to ~60000 LM of luminous flux.

The structure of the claimed LED luminaire is characterized by the following advantages:

minimal cost and labour content;

correspondence to IP67 requirements, concerning climatic operation conditions;

providing LEDs and power source operation in case of different and independent temperatures;

fast and easy procedure of power source replacement;

operation in different conditions: road, street, industrial, in dangerous enterprises (in the presence of gas, oil, petrol, chemicals etc.).

In the construction of the claimed LED luminaire hermetic zones (volumes) are absent, except for the power source, optical members with LEDs and hermetic electric wiring with wire-wire type hermetic connectors, connecting them (wire-wire type hermetic connectors have IP67 or IP68 level of protection). So, the whole construction of the claimed LED luminaire is open for external air flows, and it improves cooling the claimed LED luminaire.

Despite of the fact, that the variants of embodiment of the claimed invention, described above, were presented to illustrate the claimed invention, the specialists realize, that different modifications, addition and replacements, not going out of the limits and effect of the claimed invention, presented in the attached claim, are possible.

The invention claimed is:

1. An LED luminaire, comprising

A first case;

a second case, wherein the first case and the second case each comprise a heat-conductive material defining a hollow section with open end parts;

an edge connector;

a front end plug;

a rear end plug, wherein the edge connector, the front end plug, and the rear end plug each comprise a heat insulator and define a through ventilation opening;

a third case, comprising a heat-conductive material;

a hermetic power source;

a fastening device;

an optical member comprising an LED, wherein the optical member is connected with an external surface of a bottom part of the first case, forming a thermal contact with a portion of the first case, wherein the first case and the second case are connected together via the edge connector, wherein an end part of the first case is coupled to the front end plug, wherein an end part of the second case is coupled to the rear end plug, wherein the second case defines a hollow space, which is configured to be covered by the third case, wherein the hermetic power source is electrically and hermetically connected with the optical member and fastened to the third case, forming a thermal contact with the third case, wherein the power source is configured to be located in the hollow space of the second case, wherein the fastening device is connected with the first and second cases and configured to fasten the optical member to the external surface of the bottom part of the first case, wherein the ventilation openings of the front and rear end plugs are connected with the hollow sections of the first and second cases and are configured to allow air to flow between the first and second cases, wherein walls of the first case form a first ventilation duct, wherein walls of the second and third cases form a second ventilation duct, wherein the first and second ventilation ducts are connected through the ventilation opening of the edge connector and are configured to allow air to flow through and cool the first case, the second case, the third case and the power source, and wherein the third case is connected with the rear end plug and the edge connector by a detachable connection that is configured to allow for selective disconnection of the power source.

2. The LED luminaire according to claim 1, wherein the third case is connected with the rear end plug and the edge connector at one portion by a first articulated joint, and at another portion by a first threaded connection, and wherein the third case is configured for opening for replacement of the power source by operating the first articulated joint and twisting a first threaded member of the first threaded connection.

3. The LED luminaire according to claim 2, first threaded connection comprises a first threaded opening in the third case, extending through opening in the rear end plug and a screw, bolted in the first threaded opening in the third case and passing through the opening in the rear end plug; further comprising a second threaded connection that comprises a second threaded opening in the third case, extending through opening in the edge connector plug and a screw, bolted in the second threaded opening in the third case and passing through the opening in the edge connector; the first articulated joint comprises the opening in the rear end plug, opening in the third case and a shaft, inserted in them, performed as a screw with a nut; the second articulated joint comprises the opening in the edge connector, opening in the third case and a shaft, inserted in them, performed as a screw with a nut.

4. The LED luminaire according to claim 1, wherein the first and second cases are respectively connected with the front and rear end plugs by at least two threaded connections, each of them comprising a threaded opening in the end part of the first and second cases, through openings in the end plugs and screws, bolted in the threaded openings and passing through the openings.

5. The LED luminaire according to claim 1, wherein the first case has inner walls, which divide the hollow of the first case into through ventilation ducts, having entrances and exits at the end parts of the first case and performed with a possibility of letting in convection air flows, cooling the first case.

6. The LED luminaire according to claim 1, wherein the first case, second case and third case or preformed as aluminum structural extrusion.

7. The LED luminaire according to claim 1, wherein the first case, second case and third case are preformed as aluminum structural extrusion.

8. The LED luminaire according to claim 1, wherein the second case has a U-shape cross-section, and the first case has a rectangular cross-section.

9. The LED luminaire according to claim 1, wherein the external surface of the third case and the internal surface of the first case have longitudinal cooling cusps.

10. The LED luminaire according to claim 1, wherein an optical member with LEDs comprises a circuit board, on one side of which LEDs are located, and a lens plate, which covers the LEDs and hermetically connected with the circuit board, and the optical member with LEDs is connected with the external surface of the bottom wall of the first case by connection, that comprises knobs, located on the external surface of the bottom wall of the first case, and hitches, inserted into the knobs, and the hitches are performed as flexible elastic moldings.

11. The LED luminaire according to claim 10, wherein the lens plate is hermetically connected with the circuit board by a silicon sealing agent.

12. The LED luminaire according to claim 10, wherein the optical member with LEDs has a rectangular shape, and pressed by hitches to the external surface of the bottom wall of the case along at least two sides.

13. The LED luminaire according to claim 1, wherein the fastening device contains a crosstop and a field tube, and the front end of the crosstop is connected with the first case and the second case, and the rear end is connected with a field tube, which is performed with a possibility of connection with external bearing element.

14. The LED luminaire according to claim 1, wherein the LED luminaire comprises a bar, which is connected with the first and second cases, forming a thermal contact, and bar heat conductivity is higher than heat conductivity of the first and/or second cases.

15. The LED luminaire according to claim 1, wherein the first and second cases side walls have external T-shape long slots.

16. The LED luminaire according to claim 15, a fastening device of the LED luminaire comprises an H-shape longitudinal connector, performed with a possibility of location one of its parts in T-shape long slots of the first and second cases and fastening of its other part to the external element.

17. The LED luminaire according to claim 1, wherein the power source is electrically and hermetically connected with the optical members with LEDs by electrically hermetic connection, including hermetic electric wiring and hermetic wire-wire type electrical connectors.

18. The LED luminaire according to claim 1, wherein the edge connector has additional through ventilation openings, coming out and performed with a possibility of letting in additional convection air flows to the first and second ventilation ducts.

19. The LED luminaire according to claim 1, wherein the LED luminaire comprises a control unit, connected with the power source and performed with a possibility of brightness control and other LED luminaire parameters.

20. The LED luminaire according to claim 19, wherein the control unit is performed radio-controlled or controlled by signals, transferred via electrical wire power network of the LED luminaire.

* * * * *